US005487581A

United States Patent [19]

Carmo et al.

[11] Patent Number: 5,487,581

[45] Date of Patent: Jan. 30, 1996

[54] HAND GRIP FOR CARRYING HEAVY PLASTIC BAGS

[76] Inventors: Robert A. Carmo, 407 Michel Pl., Placentia, Calif. 92670; Edward A. Contreras, 14110 La Puertas, La Mirada, Calif. 90638

[21] Appl. No.: 430,127

[22] Filed: Apr. 25, 1995

Related U.S. Application Data

[63] Continuation of Ser. No. 214,747, Mar. 18, 1994, abandoned.

[51] Int. Cl.[6] ..... B65D 33/06

[52] U.S. Cl. ..... 294/137; 294/158; 294/159

[58] Field of Search ..... 294/26, 137, 141–143, 294/145, 153, 154, 158, 159, 166, 170, 171; 16/114 R, 114 B; 383/6, 13, 25

[56] References Cited

U.S. PATENT DOCUMENTS

| | | | |
|---|---|---|---|
| D. 137,712 | 4/1944 | Miano | 294/170 X |
| D. 219,111 | 11/1970 | Moen | 294/170 X |
| 2,749,172 | 6/1956 | Jacobs | 294/170 X |
| 4,299,342 | 11/1981 | Kessler et al. | 294/137 X |
| 4,772,059 | 9/1988 | Parry et al. | 294/170 |
| 5,169,198 | 12/1992 | Volk et al. | 294/137 |
| 5,181,757 | 1/1993 | Montoya | 294/170 X |

FOREIGN PATENT DOCUMENTS

| | | | |
|---|---|---|---|
| 7888 | 2/1980 | European Pat. Off. | 294/137 |
| 1235050 | 5/1960 | France | 294/153 |
| 2541099 | 8/1984 | France | 294/170 |
| 224527 | 3/1943 | Switzerland | 294/170 |
| 2230940 | 11/1990 | United Kingdom | 294/171 |
| 8103008 | 10/1981 | WIPO | 294/170 |
| 9111368 | 8/1991 | WIPO | 294/170 |

*Primary Examiner*—Johnny D. Cherry
*Attorney, Agent, or Firm*—Daniel L. Dawes

[57] ABSTRACT

Articles, such as a bag, may be more comfortably and securely carried by a hand grip which hooks a strand of the article, such as a strap of a bag. The hand grip is comprised of a body in which a hand hole is defined. The lower portion of the body forms a hook for grasping or hooking the strap of the article. The hand hole is contoured to provide a comfortable, noncutting surface for the user's hand, fingers or palm. The hook is formed with a wider mouth than throat so that the strap is easily placed in the hook and only somewhat less easily dislodged from the hook thereby increasing the degree of security by which the article is carried. The hand grip may be formed as a planar piece in which the hook extends to the side in the same plane as the hand hole or may be provided with one or more hooks which extend in directions out of the plane defined by the hand hole. The body is reinforced by a thickened ribbing which extends at least along one surface of the hook and in the illustrated embodiment around the entire circumferential edge of the body, hand hole and hook.

3 Claims, 3 Drawing Sheets

HAND GRIP FOR CARRYING HEAVY PLASTIC BAGS

This is a continuation of application Ser. No. 08,214,747 filed on Mar. 18, 1994, now abandoned.

BACKGROUND OF THE INVENTION

1. Field of the Invention

The invention relates to the field of hand grips and more particularly to handles for carrying bags.

2. Description of the Prior Art

The invention of a hand grip for carrying a sack or bag is nearly as ancient as the invention of the bag itself. The one probably soon followed the other. Balanced shoulder yokes, for example, contoured or resting across the shoulders of the carrier and carrying nearly equal weighted bags or sacks at each extremity of the yoke, are well recognized and ancient devices to assist in manual transport of bags and sacks around the world.

With the advent of inexpensive, light and high strength plastics, many retailers, including grocers in particular, have switched to plastic bags. Such plastic bags typically include a bag pouch or body which integrally extends to form a pair of straps defining a hand grip. Users may thus load the bag and securely grasp the bag through the hand straps, carrying anywhere from one to four bags with a single hand.

However, the heavy weight of items or groceries in such plastic bags causes the hand straps to collapse and take on the nature of thin ropes. The concentration of weight from the bag through the thinly folded hand strap quickly fatigues the normal user, and provides a hand grip varying from uncomfortable to painful.

To avoid such inconvenience, the prior art has devised designs for plastic bags which have included riveted plastic reinforcements along the top of the hand strap. These have assisted in reducing discomfort, but serve to increase the weight and cost of the bag and are often subject to detachment from the bag due to failure of the adhesive or riveting which attaches the rigid plastic handle to the flexible bag material.

Such plastic integral hand grips, however, often are difficult to handle because the grips on each side of the bag tend to detach one from each other and become splayed due to the load in the bag which tends to separate or open the bag top. Furthermore, if the user should attempt to carry more than the one such bag equipped with rigid handle reinforcements, the plurality of rigid handle segments becomes difficult to grasp in a single hand and in truth are little more comfortable than handling the bags without such reinforcements.

Flexible hand grips for carrying loads, and in particular coiled electrical cords, are shown by Farnworth, "Handle," U.S. Pat. No. 4,558,896 (1985). Such handles, however, are fabricated from semiflexible plastic and require that a strap portion be folded back without breaking over the carried article and locked into a slot in order to define a carrying loop. The required flexibility of the material dictated a certain thinness in the load carrying strap portion and hence a limitation in its strength. To the extent that the material was not highly flexible, the end of the strap tended to flip out of its locking slot, particularly if the handle was not heavily loaded. The handle also required a certain amount of manipulation to fold it over and lock the strap portion about the carried article, which manipulation discouraged its use.

Other types of handgrips include various types of common meat hooks, ice tongs and hooks, and grips for handling hay bales. While such devices could conceivably be used to hook and carry anything, none are particularly suited for use by consumers with grocery bags and therefore have been rejected by consumers for this purpose.

Therefore, what is needed is some type of hand grip which can be inexpensively manufactured, but which provides a secure comfortable grip without regard to the number of bags carried and substantially independent of the weight in the bags.

BRIEF SUMMARY OF THE INVENTION

The invention is an integral hand grip for carrying an article having an extending strand. The hand grip comprises a body, a hand hole defined in the body, and a smooth edged, rigid hook integrally formed the body below the hand hole when the hand grip is oriented for use. The hook is formed and particularly adapted to receive the strand from the article to suspend the article from the hand grip when in use. As a result, the article may be comfortably carried through use of an inexpensively manufactured hand grip.

In the illustrated embodiment the body is substantially planar. The hand hole has an interior surface which is smoothed to provide a comfortable grasping surface. The planar body has at least a peripheral reinforcing rib of increased thickness. The rib circumscribes at least a portion of the hand hole. The body has a substantially solid span disposed above the hand hole when the hand grip is oriented for carrying the article. The solid span provides a rigid element for grasping. The span has a logo surface defined therein for receiving and protecting graphic depictions. The hook defines a hook mouth and a hook throat, the hook mouth having a wider opening than the hook throat.

In another embodiment the hand grip further comprises a plurality of hooks defined in the body. In one such embodiment the plurality of hooks extend in three dimensions. In still another embodiment the hook is formed in the shape of a flat curved flange. In the preferred embodiment the hook is formed in the shape of a prismatic arm.

More specifically, the invention is an integral hand grip for facilitating the carrying of bags having one or more straps. The hand grip comprises a hand portion defining a hand hole, and a smooth edged, rigid hook portion integrally formed with the hand portion defining a hook for hooking the strap of the bag. As a result, the bag may be comfortably and easily carried.

The invention and its various embodiments may be better visualized by turning to the following drawings wherein like elements are referenced by like numerals.

The invention and its various embodiments may now be understood by turning to the following detailed description.

DETAILED DESCRIPTION OF THE PREFERRED EMBODIMENTS

Articles, such as a bag, may be more comfortably and securely carried by a hand grip which hooks a strand of the article, such as a strap of a bag. The hand grip is comprised of a body in which a hand hole is defined. The lower portion of the body forms a hook for grasping or hooking the strap of the article. The hand hole is contoured to provide a comfortable, noncutting surface for the user's hand, fingers or palm. The hook is formed with a wider mouth than throat so that the strap is easily placed in the hook and only somewhat less easily dislodged from the hook thereby increasing the degree of security by which the article is carried. The hand grip may be formed as a planar piece in which the hook extends to the side in the same plane as the hand hole or may be provided with one or more hooks which extend in directions out of the plane defined by the hand hole. The body is reinforced by a thickened ribbing which extends at least along one surface of the hook and in the illustrated embodiment around the entire circumferential edge of the body, hand hole and hook.

Figure 1:
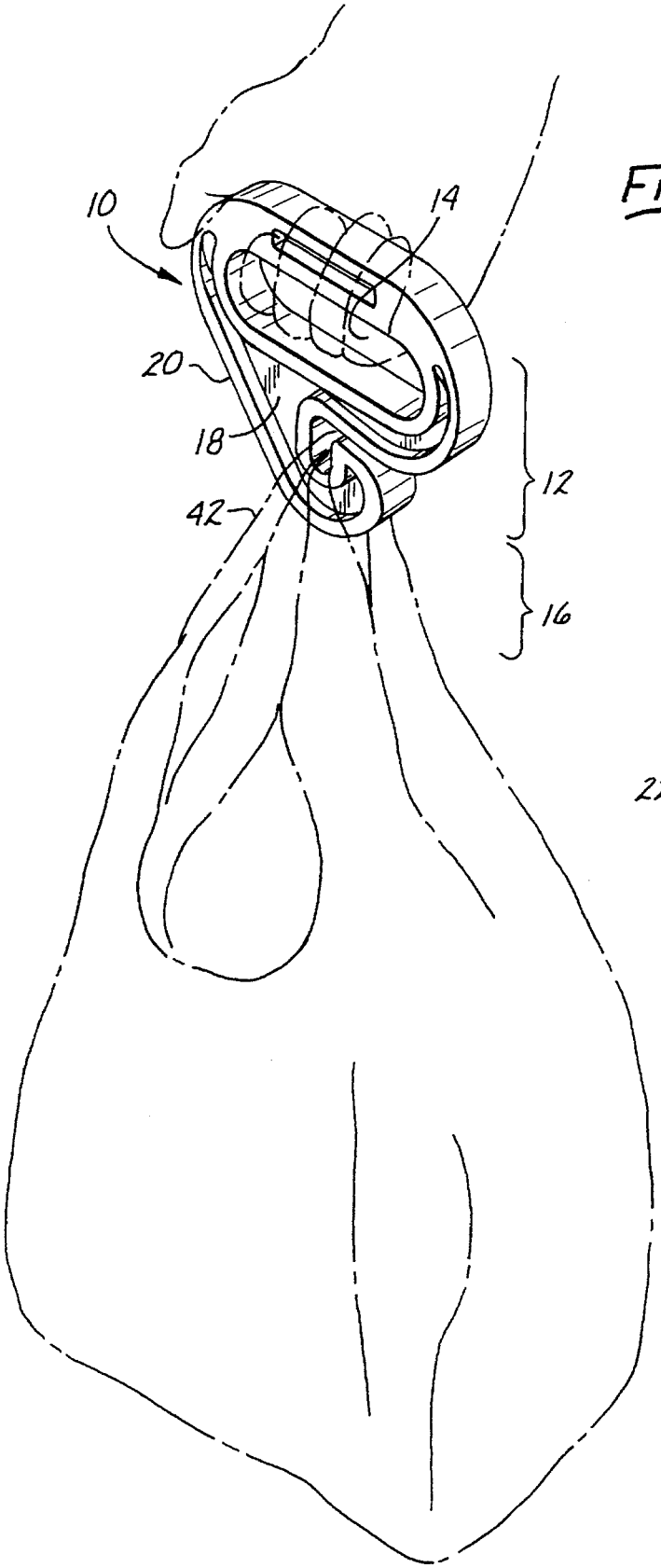
FIG. 1 is a perspective view of the hand grip of the invention as shown as being carried by the user and loaded with at least one plastic grocery bag.

FIG. 1 is a perspective view of the hand grip of the invention, generally denoted by reference numeral 10. Hand grip 10 is comprised of a hand portion 12 in which a hand hole 14 is defined, and a hook portion 16. In the preferred embodiments hand grip 10 is integral and formed of molded plastic. Many other materials could be substituted including metal, wood and pressed fiber materials.

Hand grip 10 of FIG. 1 is characterized by a thinner center wall 18, which in the illustrated embodiment is approximately 0.15 inch thick. Center wall 18 in turn is surrounded by a thickened reinforcing beam edge 20 which in the illustrated embodiment is approximately 0.62 inch thick and which extends around the entire periphery of hand grip 10 and hand hole 14. However, as seen best in the cross-sectional view of FIG. 3, the thickness of grip 10 in the illustrated embodiment tapers slightly outward as one moves down from the top at hand portion 12 to hook portion 16. The thickness of grip 10 at the top is approximately 0.50 inch and it thickens to approximately 0.620 inch at the bottom near hook 22. This tapering allows for a more comfortable and ergonomic hand grip, but allows additional thickness and strength in hook 22. It is of course expressly understood that the dimensions of the claimed invention are not so limited and may be varied according to the teachings of the invention depending on the strength of the material used and the specific application to which hand grip 10 is applied.

Hook portion 16 of hand grip 10 includes a curved element or hook 22 formed in the shape of a rigid upwardly directed hook defining a hook neck 24. Hook 22 is arranged and configured so that neck 24 has a center line 26 which is aligned with center line 26 of hand grip 10 as best depicted in the front elevational view of FIG. 2. In the illustrated embodiment, the width. 28 of neck 24 is approximately 0.375 inch and its length 30 along axis 26 is approximately 0.816 inch. The specific dimensions of hand grip 10 recited in the specification are, of course, entirely illustrative and should not be read as limiting the invention which may have any equivalent topological form regardless not only of dimension, but also of any specific geometry as long as the functional elements as taught are present.

Figure 2:
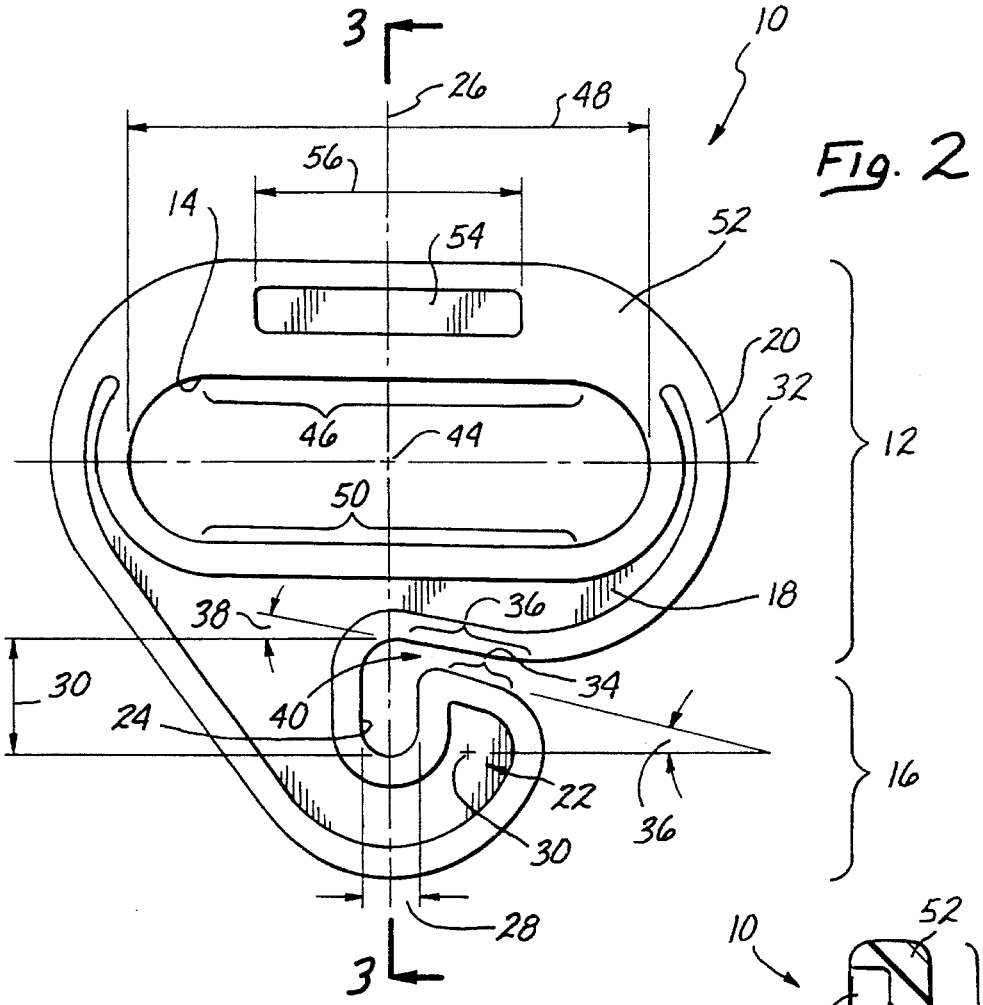
FIG. 2 is a plan elevational view of the side of the hand grip to FIG. 1.

In the illustrated embodiment, hook 22 extends to the right of center line 26 as seen in FIG. 2 so that it has a center point 30 approximately in the middle of center wall 18 extending into the body of hook 22 at a position approximately 0.52 inch from center line 26 and approximately 1.938 inch below a center line 32 defined through hand hole 14. Upper portion 34 of hook 22 is angled downwardly as portion 34 slopes away from center line 26 to the right as shown in FIG. 2, making in the illustrated embodiment approximately a 15 degree angle 36 with the horizontal. In the meantime, opposing portion 36 of hook portion 16 of hand grip 10 has a similarly downward sloping surface as one moves from center line 26 to the right in FIG. 2. Portion 36, however, slopes downward with respect to the horizontal at an angle 38 of approximately 10 degrees, thus, surfaces 34 and 36 provide a hook mouth generally denoted by reference numeral 40 which is wider at its right most opening shown in FIG. 2 than it is at its left most opening in FIG. 2. This serves to guide and squeeze down the straps 42 of the bag or sack which is placed within hand grip 10 as shown in FIG. 1.

Hand portion 12 of hand grip 10 is characterized by the generally oblong hand hole 14 which is symmetric about a center point 44 and center lines 26 and 32. Other shapes for hand hole 14 may be employed as is known to the art or earlier devised. For example, the upper surface 46 of hand hole 14 may be contoured instead of straight in order to comfortably conform to the fingers. In the illustrated embodiment, length 48 of hand hole 14 is approximately 3.4 inches so that hand grip 10 is designed to be lifted by the average user's fingers as opposed to being slipped over the palm. However, hand hole 14 can be modified so as to be grasped by or conformed to other portions of the average user's hand, fingers or palm.

Figure 3:
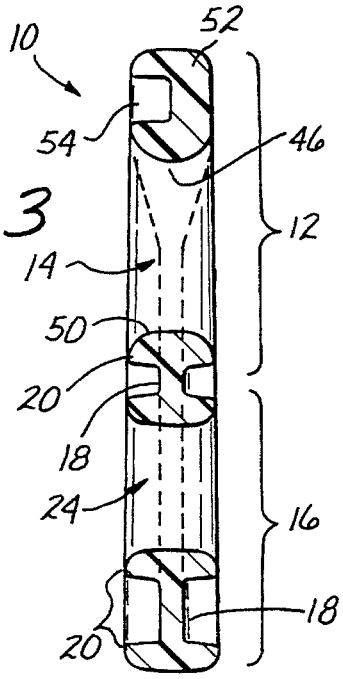
FIG. 3 is a cross-sectional view taken through section lines 3—3 of FIG. 2.

The profile contour of hand hole 14 is best illustrated in the side cross sectional view of FIG. 3. Lower surface 46 of hand hole 14 is shown as being smooth or rounded, which in the illustrated embodiment is a circular rounding of approximately 0.25 inch radius. Such rounding is provided along the entire inner periphery of hand hole 14 on border 20, both on upper surface 46 and lower surface 50. Further, hand portion 12 of hand grip 10 which is disposed above surface 46 is generally solid, having the thickness of reinforcing rib 20. This provides a rigid top span across width 48 to provide a solid and comfortable hand grip for the user.

In the illustrated embodiment, a portion of upper hand span 52 is provided with a logo block 54 into which a retailer's logo or design can be defined, printed, or other suitable decal affixed. In the illustrated embodiment, surface 54 is provided with a width 56 approximately 0.3 inch wide, and its surface is indented so that it is flush with hand hole 14 on one side of span 52. This allows for a degree of protection of surface 54 so that any decals, or depictions placed thereon are protected from abrasion or other degradation. This allows hand grip 10 to be used as a promotional piece for a retailer over an extended period of time without loss of the advertising value imparted to hand grip 10 by means abrading on surface 54.

The illustrated embodiment has been shown as usable with grocery bags, but is not strictly so limited in its range of applications. For example, the form and dimensions of hand grip 10 may be suitably modified according to teachings in invention so that it is useful as a hand grip for carrying coiled electrical extension cords and further serves as a hook or means by which such coils may be stored.

Still further, hand grip 10*a* may be provided with a plurality of hooks 22*a* in addition to the single hook as shown in FIGS. 1–3. For example, substantially the same configuration of hand grip 10 can be provided as shown in FIG. 2, but with a hook 22*a* extending to both the left and right side of hand grip 10*a* as shown by way of example in the front plan elevational view of FIG. 4.

Hand grip 10 has been shown in the illustrated embodiments of FIGS. 1–4 generally as a two dimensional hand grip. The design may also be extended according to the spirit of the present teachings to include a three dimensional array of hooks 22*b* such as depicted in the perspective view of FIG. 5, wherein three such hooks 22*b* are provided extending in three dimensions as a symmetrical tri-hook.

Figure 5:
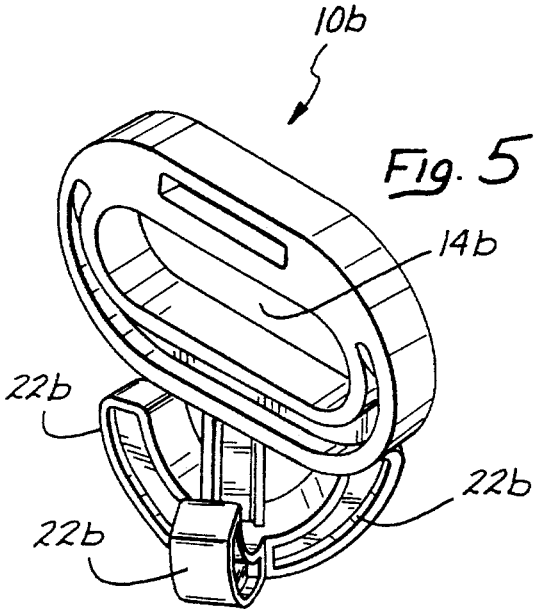
FIG. 5 is a perspective view of another embodiment of the invention of the hand grip having multiple hooks extending in three dimensions.
Figure 6:
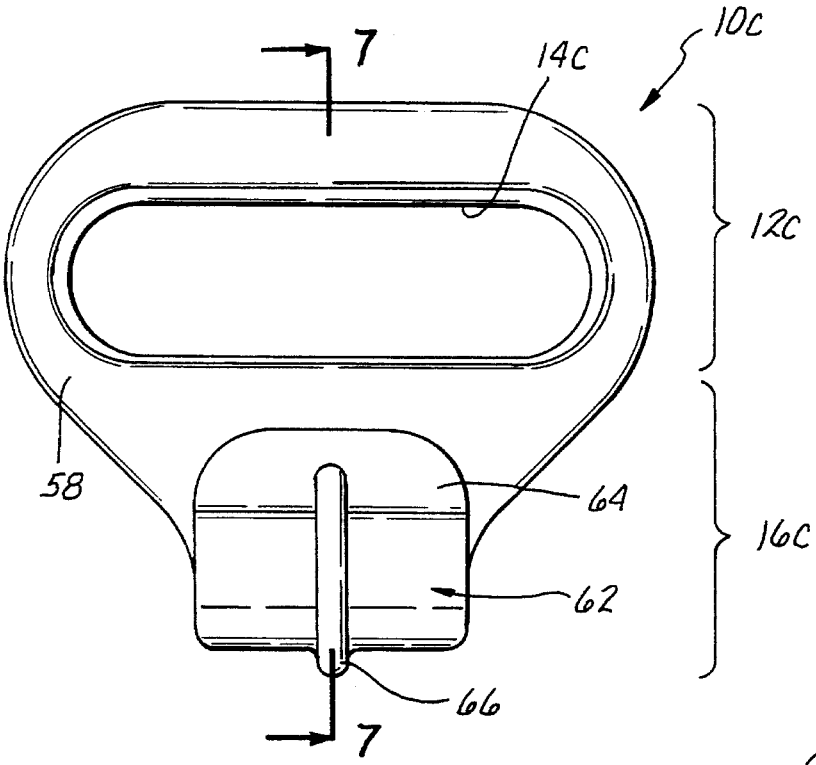
FIG. 6 is a front elevational view of another embodiment of the invention having a flanged shaped hook.
Figure 7:
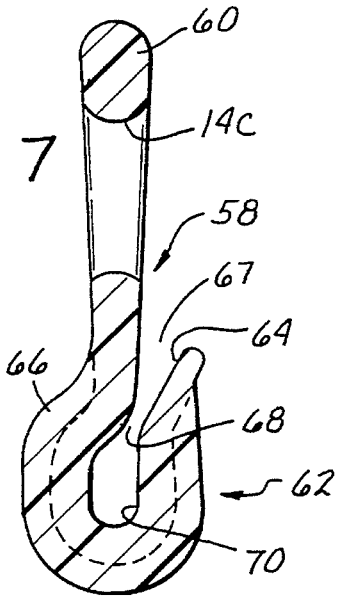
FIG. 7 is a cross-sectional view of the embodiment of FIG. 6 as seen through sectional lines 7—7 of FIG. 6.

FIGS. 6 and 7 show another embodiment of hand grip 10*c*. Hand grip 10*c* again is comprised of a body portion 12*c* and a hook portion 16*c*. Again, a contoured hand hole 14*c* is defined in hand portion 12*c* in a manner similar to that described in connection with the embodiments of FIGS. 1–5.

However, in the embodiments of FIGS. 6 and 7 hand grip 10*c* is formed of a single solid body 58 without the circumferential ribbing 20 as depicted in the embodiment of FIGS. 1–5. The thickness of body 58 is maximal in hand grip span 60 and thins as it approaches hook portion 16*c* as best depicted in the side cross sectional view shown in FIG. 7. Hook 62 in the embodiment of FIGS. 6 and 7 is shaped in the form of a flattened flange 64 having a single exterior reinforcing integral rib 66 extending from body 58 along the exterior surface of flange 64.

As before, hook 62 defines a hook mouth 67 and hook throat 68 each having a width or separation between the opposing surface of flange 64 in body 58. Hook mouth 67 is wider than hook throat 68 thereby providing a pinching effect to the strand or strap which is inserted within hook 62 and which eventually comes to securely rest within hook neck 70.

Figure 4:
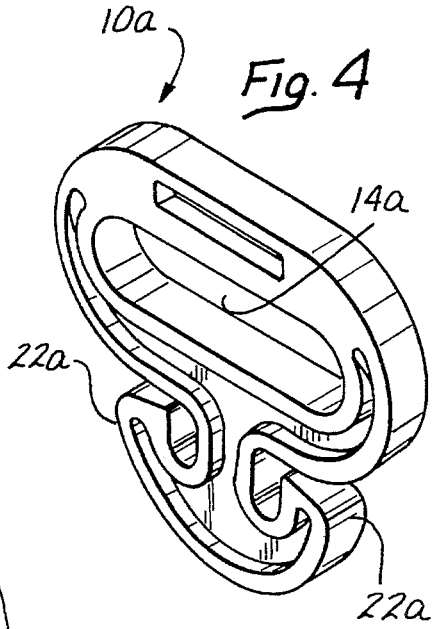
FIG. 4 is a front elevational view of another embodiment of the invention having double opposing hooks.

As before, although the embodiment of FIGS. 6 and 7 is shown in the form of a single hook, two or more hooks of the type shown in FIGS. 6 and 7 may be combined in hand grip 10*c* in the manner analogous to that shown in connection with FIGS. 4 and 5 with respect to the hook design of FIGS. 1–3.

Figure 8:
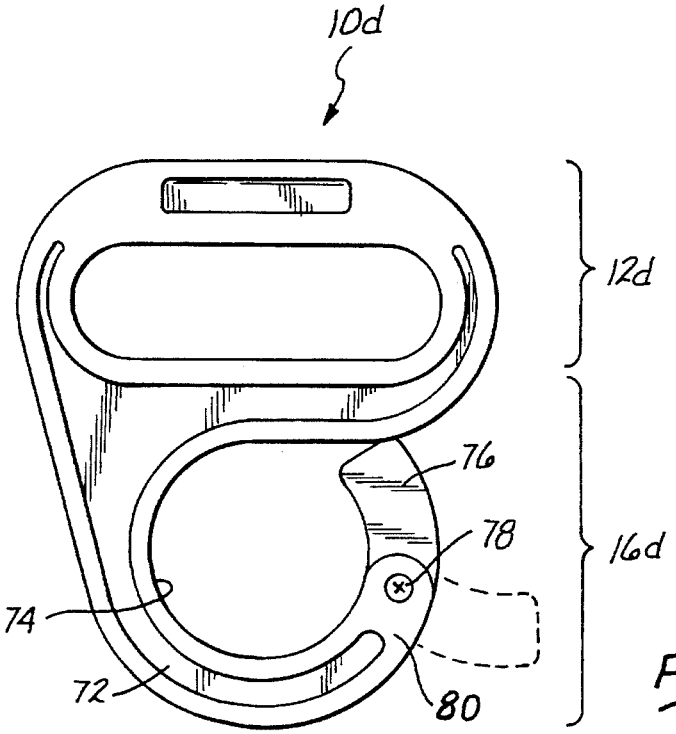
FIG. 8 is a front plan elevational view of another embodiment wherein a latch is combined with the hook portion of the handgrip.

FIG. 8 is a front plan elevational view of another embodiment of the invention similar to that of FIGS. 1–3 except that hook portion 16 has been modified to the shape of a circular hook 72 defining a large circular neck 74. A latching arm 76 is pivotally coupled to end 80 of hook 72 about a screw post 78. Latching arm 76 is shown in closed configuration in solid outline and in an open configuration in dotted outline. Latching arm 76 may be maintained in one position or the other either by friction or by a separate conventional detent or latching mechanism (not shown). The embodiment of FIG. 8 is of particular utility as a storage grip and carrier for coiled electrical extension cords, wire and rope.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the essential idea of the invention.

We claim:

1. An integral hand grip for carrying an article having an extending strap comprising:

a substantially planar body with a first thickness having at least a peripheral reinforcing rib, said peripheral reinforcing rib having a second thickness greater than said first thickness of said planar body, said planar body defining a plane of said grip;

a closed hand hole defined in said body and being defined in said plane of said grip, said hand hole having an interior surface which is smoothed to provide a comfortable grasping surface, said rib circumscribing at least a portion of said hand hole, wherein said body has a substantially solid span disposed above said hand hole when said hand grip is oriented for carrying said article, said solid span providing a rigid element for grasping and having a thickness approximately equal to said second thickness of said rib; and a single smooth edged, rigid hook integrally formed with said body below said hand hole when said hand grip is oriented for use, said hook for receiving said strap from said article to suspend said article from said hand grip when in use, said hook receiving said strap at a first center point within said hook, said hand hole having a second center point center, said first center point of said hook being aligned with said second center point of said hand hole so that said grip is balanced when loaded with said article to permit holding of said grip without substantial torque being applied thereto by said article when said grip is held in its normal orientation, said hook having a hook mouth, said hook mouth being oriented in said direction of said hand hole so that a selected rotation of said grip around an axis perpendicular to said plane of said grip rotates said mouth of said hook downwardly to allow said strap of said article to be unloaded from said grip, whereby said article may be comfortably carried.

2. An integral hand grip for facilitating the carrying of a bag having one or more straps comprising:

a hand portion in the form of a substantially planar member defining a hand hole therein, said hand portion having a solid span disposed above said hand hole when said hand grip is oriented for carrying said bag, said solid span having a surface shaped to conform to a predetermined part of a human hand, said hand portion having a center of effort where restraining force from said human hand on said hand portion can be considered as being concentrated when said grip is hand carried; and a single smooth edged, rigid hook portion reinforced by at least one rib and integrally formed with said hand portion, said hook portion defining a hook for hooking said strap of said bag, said hook portion having a center of loading, said center of loading of said hook portion being substantially aligned with said center of effort of said hand portion when said hand portion is carred in its normal position so that said hand is not turned when normally carrying said grip, said hook portion having an orientation aligned in parallel with said substantially planar member of said hand portion so that a predetermined rotation of said hand portion serves to unload said bag from said hook portion, whereby said bag may be comfortably and easily carried.

3. An integral hand grip for carrying an article having an extending strap comprising:

a substantially planar body with a first thickness having at least a peripheral reinforcing rib, said peripheral reinforcing rib having a second thickness greater than said first thickness of said planar body, said body having a longitudinal centerline and defining a plane of said planar body;

a closed hand hole defined in said body symmetrically about said longitudinal centerline; and a single rigid hook integrally formed with said body below said hand hole when said hand grip is oriented for use, said hook for receiving said strap from said article to suspend said article from said hand grip when in use, said hook having a mouth with a center and an open throat, said mouth and throat of said hook being coplanar with said planar body, said center of said mouth being aligned with said longitudinal centerline so that when said strap of said article is disposed in said mouth of said hook, said hand grip is balanced when in its normally carried orientation, said throat being open to allow disposition of said strap into said mouth of said hook from outside said grip, and disposition of said strap out of said mouth of said hook by rotation of said grip in said plane of said planar body, whereby said article may be comfortably carried.

* * * * *